US011408643B2

(12) United States Patent
Hasegawa

(10) Patent No.: US 11,408,643 B2
(45) Date of Patent: Aug. 9, 2022

(54) WATER HEATING APPARATUS WITH IMMEDIATE HOT WATER SUPPLY FUNCTION AND WATER HEATING SYSTEM

(71) Applicant: NORITZ CORPORATION, Hyogo (JP)

(72) Inventor: Takahide Hasegawa, Kakogawa (JP)

(73) Assignee: NORITZ CORPORATION, Hyogo (JP)

( * ) Notice: Subject to any disclaimer, the term of this patent is extended or adjusted under 35 U.S.C. 154(b) by 38 days.

(21) Appl. No.: 16/796,354

(22) Filed: Feb. 20, 2020

(65) Prior Publication Data

US 2020/0271356 A1 Aug. 27, 2020

(30) Foreign Application Priority Data

Feb. 26, 2019 (JP) ..... JP2019-032934

(51) Int. Cl.

| | |
|---|---|
| ***F24H 9/20*** | (2022.01) |
| ***F24D 19/10*** | (2006.01) |
| ***F24H 1/12*** | (2022.01) |
| ***F24H 1/10*** | (2022.01) |

(52) U.S. Cl.

CPC ..... *F24H 9/2035* (2013.01); *F24D 19/1051* (2013.01); *F24H 1/124* (2013.01); *F24D 2220/042* (2013.01); *F24H 1/107* (2013.01)

(58) Field of Classification Search

CPC .... F24D 17/0078; F24D 19/1051; F24D 3/02; F24D 2220/0292; F24D 19/21; F24H 9/2035; F24H 1/124; F24H 1/107; F24H 1/145

USPC ..... 122/448.1

See application file for complete search history.

(56) References Cited

U.S. PATENT DOCUMENTS

| | | | | |
|---|---|---|---|---|
| 6,109,050 | A * | 8/2000 | Zakryk | E04H 4/129 4/493 |
| 6,536,464 | B1 | 3/2003 | Lum et al. | |
| 7,073,528 | B2 * | 7/2006 | Kempf | E03B 7/045 122/13.3 |
| 2006/0222349 | A1 * | 10/2006 | Sturm | F24H 9/2028 392/463 |

(Continued)

FOREIGN PATENT DOCUMENTS

| | | | |
|---|---|---|---|
| JP | H08200805 | A * | 8/1996 |
| JP | 2001311548 | A * | 11/2001 |

(Continued)

*Primary Examiner* — Michael G Hoang
*Assistant Examiner* — Andrew W Cheung
(74) *Attorney, Agent, or Firm* — Studebaker & Brackett PC

(57) ABSTRACT

As a circulation pump is activated while a hot water supply faucet is closed, an immediate hot water supply circulation path is formed to bypass the hot water supply faucet on the outside of a water heating apparatus and to pass through a heat exchanger in the inside of the water heating apparatus. A controller determines in a test mode, whether or not the immediate hot water supply circulation path has been formed by connection of a thermal water stop bypass valve, based on whether or not a temperature detector senses increase in temperature to a predetermined criterion temperature while the circulation pump and a heat source apparatus are active.

14 Claims, 8 Drawing Sheets

(56) References Cited

U.S. PATENT DOCUMENTS

| | | | | |
|---|---|---|---|---|
| 2010/0089339 | A1* | 4/2010 | Krause | F24D 17/0078<br>122/19.1 |
| 2012/0192965 | A1* | 8/2012 | Popper | E03B 7/04<br>137/357 |
| 2016/0186415 | A1* | 6/2016 | Yuge | F24D 17/0078<br>137/340 |
| 2016/0187894 | A1* | 6/2016 | Malky | F24D 19/1012<br>700/276 |
| 2016/0245534 | A1* | 8/2016 | Halff | F24D 19/1051 |
| 2017/0122575 | A1* | 5/2017 | Acker | G05B 15/02 |

FOREIGN PATENT DOCUMENTS

| | | | | |
|---|---|---|---|---|
| JP | 2002229637 | A | * | 8/2002 |
| JP | 3629620 | B2 | * | 3/2005 |
| JP | 3777763 | B2 | * | 5/2006 |
| JP | 5408425 | B2 | | 2/2014 |
| JP | 2017-048984 | A | | 3/2017 |

* cited by examiner

| | LOW-TEMPERATURE STATE | HIGH-TEMPERATURE STATE |
|---|---|---|
| WHILE FAUCET IS OPEN | 201→203(Pa), 202→204(Pb) | |
| WHILE FAUCET IS CLOSED | 201→202(Pc) | CLOSED |

| CROSSOVER VALVE | |
|---|---|
| NOT CONNECTED (1A) | Td>Tr |
| CONNECTED (1B) | Qd<Qr |

WATER HEATING APPARATUS WITH IMMEDIATE HOT WATER SUPPLY FUNCTION AND WATER HEATING SYSTEM

BACKGROUND OF THE INVENTION

Field of the Invention

The present disclosure relates to a water heating apparatus and a water heating system and more particularly to a water heating apparatus with an immediate hot water supply function and a water heating system.

Description of the Background Art

A water heating apparatus of one form is equipped with what is called an immediate hot water supply function for outputting hot water at an appropriate temperature immediately after start of hot water supply even after hot water supply has been off for a long period of time. Normally, in order to achieve the immediate hot water supply function, a mode in which a circulation path that goes through a heat source also while hot water supply is off is formed (an "immediate hot water supply operation mode" below) should be provided.

U.S. Pat. No. 6,536,464 discloses a configuration for forming a circulation path for the immediate hot water supply function by externally connecting a bypass valve (which is also referred to as a "crossover valve" below) for thermostatic control using a wax thermostatic element. The immediate hot water supply function can thus be achieved by simplified attachment works without adding a function to control the crossover valve on a side of the water heating apparatus.

SUMMARY OF THE INVENTION

In the immediate hot water supply operation mode, a circulation path that goes through a heat source (an immediate hot water supply circulation path below) is formed by activation of a circulation pump provided in the inside or outside of the water heating apparatus. The immediate hot water supply circulation path, however, can also be formed by additionally arranging a pipe for circulation, rather than connection of a crossover valve.

In a configuration where the crossover valve is externally connected, with increase in water temperature in the immediate hot water supply circulation path owing to reception of heat from the heat source, the wax thermostatic element physically closes the path. In a configuration where the crossover valve is not externally connected, on the other hand, even though a temperature of water in the immediate hot water supply circulation path increases, the path remains formed as going through a circulation pipe or the like. Therefore, in the water heating apparatus with the immediate hot water supply function, control in the immediate hot water supply operation mode should be switched depending on whether or not a thermal water stop bypass valve represented by the crossover valve is externally connected.

External connection of the crossover valve (the thermal water stop bypass valve) has normally been recognized by a controller of the water heating apparatus based on a special operation input by a worker such as an operation of a line or a switch in the inside after the worker opened a front panel in attachment works. Therefore, there is a concern about increase in workloads imposed on an installer.

The present disclosure was made to solve such problems, and an object of the present disclosure is to provide in a water heating apparatus with an immediate hot water supply function and a water heating system, a function to automatically determine whether or not a thermal water stop bypass valve represented by a crossover valve has externally been connected to the water heating apparatus.

According to one aspect of the present disclosure, a water heating apparatus that outputs hot water to a hot water supply faucet includes a heating mechanism, an inner path formed when a circulation pump is activated while the hot water supply faucet is closed, a flow rate detector, a temperature detector, and a controller that gives an instruction to activate and deactivate the heating mechanism and the circulation pump. The inner path forms an immediate hot water supply circulation path through which a fluid passes through the heating mechanism, together with an outer path that bypasses the hot water supply faucet on the outside of the water heating apparatus. The flow rate detector senses a flow in the immediate hot water supply circulation path. The temperature detector detects a temperature of the fluid in the immediate hot water supply circulation path. The controller determines, in a test mode, whether or not the immediate hot water supply circulation path has been formed by connection of a thermal water stop bypass valve, based on whether or not the temperature detector senses increase in temperature of the fluid to a predetermined criterion temperature while the circulation pump and the heating mechanism are active.

According to another aspect of the present disclosure, a water heating system includes a water heating apparatus including a heating mechanism, a low-temperature water pipe, a high-temperature water pipe, a circulation pump arranged inside or outside the water heating apparatus, an immediate hot water supply circulation path formed as the circulation pump is activated while the hot water supply faucet is closed, a flow rate detector that senses a flow in the immediate hot water supply circulation path, and a temperature detector that detects a temperature of a fluid in the immediate hot water supply circulation path. The low-temperature water pipe introduces low-temperature water to a water entry port of the water heating apparatus. The high-temperature water pipe connects a hot water output port of the water heating apparatus and the hot water supply faucet to each other. The immediate hot water supply circulation path is formed to include at least one of the low-temperature water pipe and the high-temperature water pipe and to bypass the hot water supply faucet on the outside of the water heating apparatus, and to pass through the heating mechanism in the inside of the water heating apparatus. The water heating apparatus further includes a controller that gives an instruction to activate and deactivate the heating mechanism and the circulation pump. The controller determines, in a test mode, whether or not the immediate hot water supply circulation path has been formed by connection of a thermal water stop bypass valve, based on whether or not the temperature detector senses increase in temperature of the fluid to a predetermined criterion temperature while the circulation pump and the heating mechanism are active.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
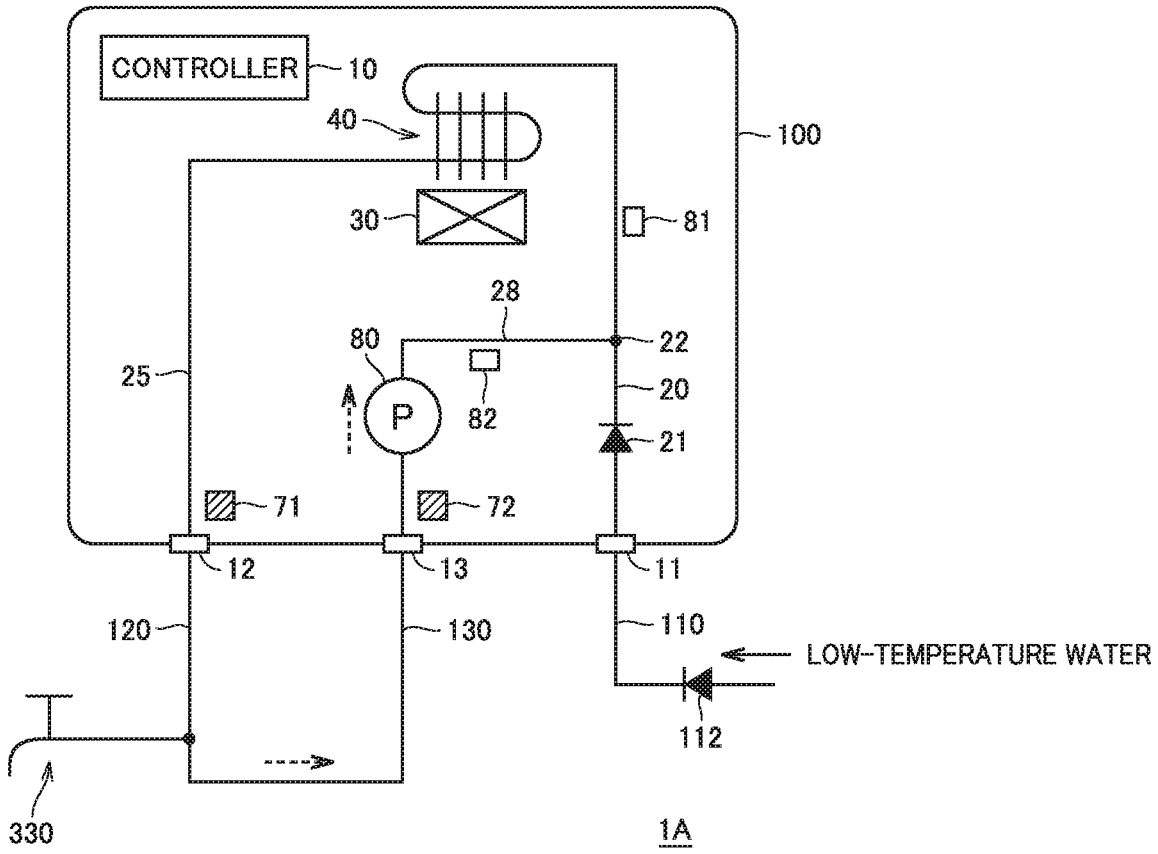
FIG. 1 is a block diagram illustrating a configuration of a water heating system provided with an immediate hot water supply function by disposing a circulation pipe.

An embodiment of the present disclosure will be described in detail below with reference to the drawings. The same or corresponding elements in the drawings below have the same reference characters allotted and description thereof will not be repeated in principle.

A water heating system in which an immediate hot water supply circulation path is formed by a circulation pipe without external connection of a crossover valve described above will initially be described.

FIG. 1 is a block diagram illustrating a configuration of a water heating system provided with an immediate hot water supply function by disposing a circulation pipe.

Referring to FIG. 1, a water heating system 1A includes a water heating apparatus 100, a low-temperature water pipe 110, a high-temperature water pipe 120, and a circulation pipe 130. Water heating apparatus 100 includes a water entry port 11, a hot water output port 12, and a circulation port 13.

Low-temperature water pipe 110 is supplied with low-temperature water through a check valve 112. Low-temperature water is representatively supplied from a not-shown water supply pipe. Low-temperature water pipe 110 is connected to water entry port 11. High-temperature water pipe 120 connects hot water output port 12 and a hot water supply faucet 330 to each other. Circulation pipe 130 connects high-temperature water pipe 120 and circulation port 13 to each other.

Water heating apparatus 100 includes a controller 10, a water entry path 20, a hot water output path 25, a circulation path 28, a heat source apparatus 30, a heat exchanger 40, and a circulation pump 80. Water entry path 20 is formed between water entry port 11 and an input side (upstream side) of heat exchanger 40 with a check valve 21 being interposed.

Heat source apparatus 30 is representatively implemented by a burner that generates a quantity of heat by combustion of gas or petroleum. Heat exchanger 40 increases a temperature of low-temperature water (fluid) introduced through water entry path 20 by using the quantity of heat generated by heat source apparatus 30. Therefore, heat source apparatus 30 and heat exchanger 40 can implement an embodiment of the "heating mechanism." Alternatively, the "heating mechanism" can also be implemented by a heat pump or exhaust heat during power generation.

Hot water output path 25 is formed between an output side (downstream side) of heat exchanger 40 and hot water output port 12. Circulation path 28 is formed between circulation port 13 and water entry path 20 (a connection point 22).

Circulation pump 80 is connected to circulation path 28. Alternatively, circulation pump 80 may be arranged in circulation pipe 130 on the outside of water heating apparatus 100. Activation and deactivation of circulation pump 80 are controlled by controller 10.

A flow rate detector 81 that outputs a value of a flow rate of low-temperature water is arranged in water entry path 20 and a flow rate detector 82 is arranged in circulation path 28. Flow rate detector 82 may be implemented by a sensor that outputs a value of an actual flow rate similarly to flow rate detector 81, or may be implemented by a water flow sensor (switch) that detects whether or not there is a flow. Detection values from flow rate detectors 81 and 82 are input to controller 10.

A temperature detector 71 is arranged in hot water output path 25 and a temperature detector 72 is arranged in circulation path 28. Fluid temperatures detected by temperature detectors 71 and 72 are input to controller 10.

Figure 2:
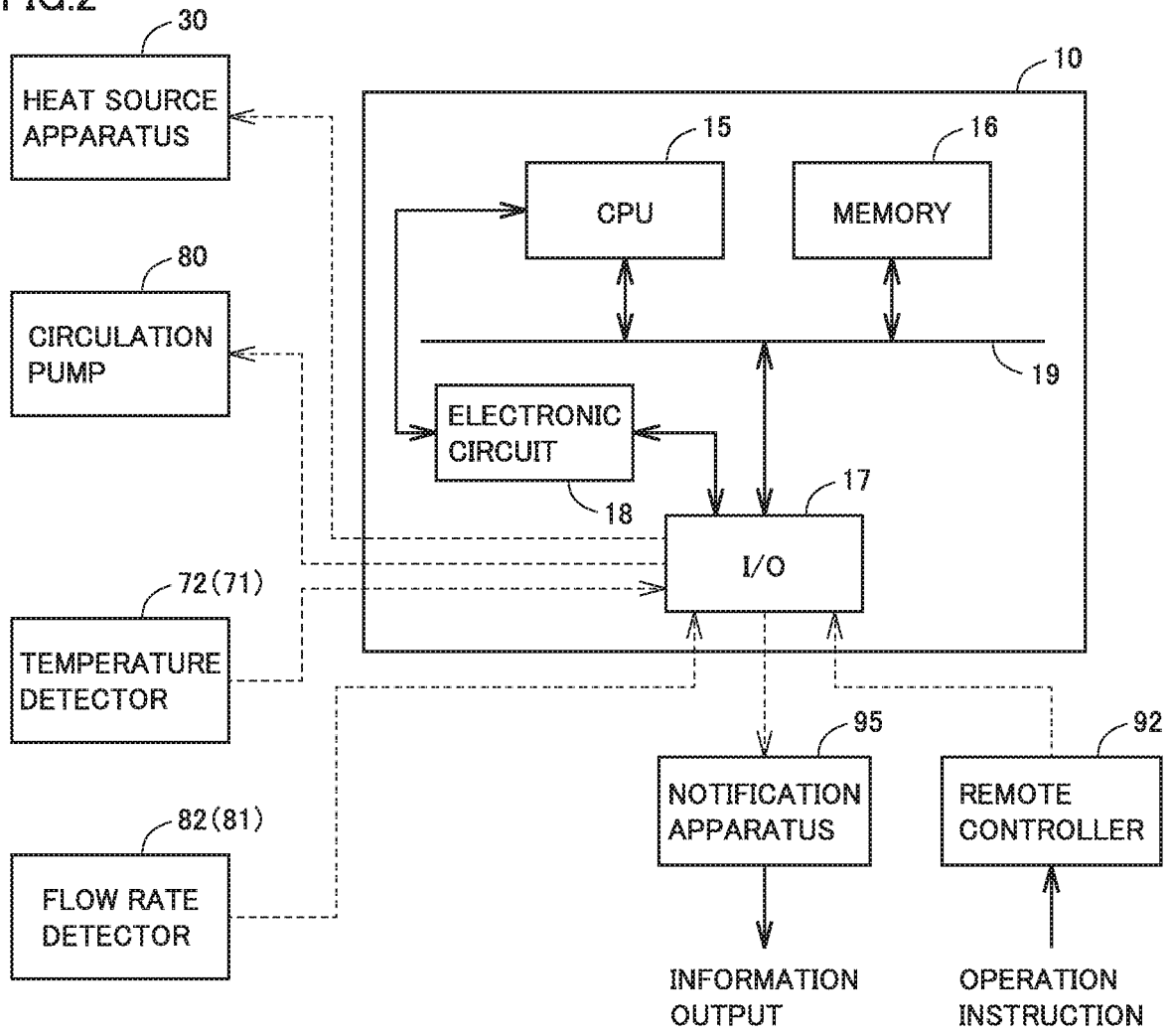
FIG. 2 is a block diagram illustrating an exemplary hardware configuration of a controller shown in FIG. 1.

FIG. 2 is a block diagram illustrating an exemplary hardware configuration of controller 10.

Referring to FIG. 2, controller 10 is representatively implemented by a microcomputer. Controller 10 includes a central processing unit (CPU) 15, a memory 16, an input and output (I/O) circuit 17, and an electronic circuit 18. CPU 15, memory 16, and I/O circuit 17 can transmit and receive signals to one another through a bus 19. Electronic circuit 18 is configured to perform prescribed operation processing with dedicated hardware. Electronic circuit 18 can transmit and receive signals to and from CPU 15 and I/O circuit 17.

CPU 15 receives output signals (detection values) from sensors including temperature detectors 71 and 72 and flow rate detectors 81 and 82 through I/O circuit 17. CPU 15 further receives a signal indicating an operation instruction input to a remote controller 92 through I/O circuit 17. The operation instruction includes, for example, an operation to switch on and off an operation switch of water heating apparatus 100, a set hot water supply temperature, and various types of programmed time setting (which is also referred to as "timer setting"). CPU 15 controls operations by constituent apparatuses including heat source apparatus 30 and circulation pump 80 such that water heating apparatus 100 operates in accordance with the operation instruction.

CPU 15 can output visually or aurally recognizable information by controlling a notification apparatus 95. For example, notification apparatus 95 can output information by showing visually recognizable information such as characters and graphics on a screen. In this case, notification apparatus 95 can be implemented by a display screen provided in remote controller 92. Alternatively, notification apparatus 95 may be implemented by a speaker so that information can also be output by voice and sound or melodies.

Operations by water heating apparatus 100 will be described with reference to FIG. 1 again.

While the faucet is open, that is, while hot water supply faucet 330 is open, low-temperature water is introduced into water entry path 20 by a supply pressure of low-temperature water. When flow rate detector 81 detects a flow rate exceeding a minimum operating quantity (MOQ) of working water while the operation switch of water heating apparatus 100 is on, controller 10 activates heat source apparatus 30. Consequently, high-temperature water heated by heat source apparatus 30 and heat exchanger 40 is output to high-temperature water pipe 120 and hot water supply faucet 330 through hot water output path 25 and hot water output port 12, so that a hot water supply operation is performed. During the hot water supply operation, circulation pump 80 is deactivated and an amount of heating by heat source apparatus 30 (heating mechanism) is controlled such that a temperature of a fluid (hot water output temperature) detected by temperature detector 71 is controlled to a set hot water supply temperature input to remote controller 92.

While the hot water supply operation is off, a temperature of a fluid that remains in hot water output path 25 and high-temperature water pipe 120 is lowered. Therefore, there is a concern about a long time period required until high-temperature water at an appropriate temperature is output from hot water supply faucet 330 after start of the next hot water supply operation. Therefore, water heating apparatus 100 is provided with an immediate hot water supply function for promptly supplying high-temperature water at an appropriate temperature after start of the hot water supply operation. The immediate hot water supply function is performed by forming an immediate hot water supply circulation path including heat source apparatus 30 and heat exchanger 40 by activation of circulation pump 80 while the faucet is closed, that is, while hot water supply faucet 330 is closed.

For example, a user can indicate by timer setting, a period for which the immediate hot water supply operation mode is to be executed. Timer setting can be input, for example, by operating remote controller 92. Alternatively, the period for which the immediate hot water supply operation mode is to be executed may automatically be set based on learning of a history of use by the user in the past.

In the immediate hot water supply operation mode, by activating circulation pump 80 and heat source apparatus 30 (heating mechanism), a fluid path (inner path) including circulation port 13, circulation path 28, water entry path 20 (downstream from connection point 22), heat exchanger 40 (heating mechanism), hot water output path 25, and hot water output port 12 can be formed in the inside of water heating apparatus 100. In addition, since a fluid path (outer path) that includes hot water output port 12, high-temperature water pipe 120, circulation pipe 130, and circulation port 13 and bypasses hot water supply faucet 330 can be formed on the outside of water heating apparatus 100, this fluid path can form, together with the inner path, the immediate hot water supply circulation path. Consequently, in water heating system 1A, a hot water supply operation to supply high-temperature water at an appropriate temperature can be started from immediately after the faucet is opened, by allowing a flow of high-temperature water at the appropriate temperature through the immediate hot water supply circulation path also while the faucet is closed.

Thus, in water heating system 1A shown in FIG. 1, by disposing circulation pipe 130 in water heating apparatus 100, the immediate hot water supply function can be performed under the control of circulation pump 80 by controller 10, without connection of a crossover valve.

Figures 3, 4:
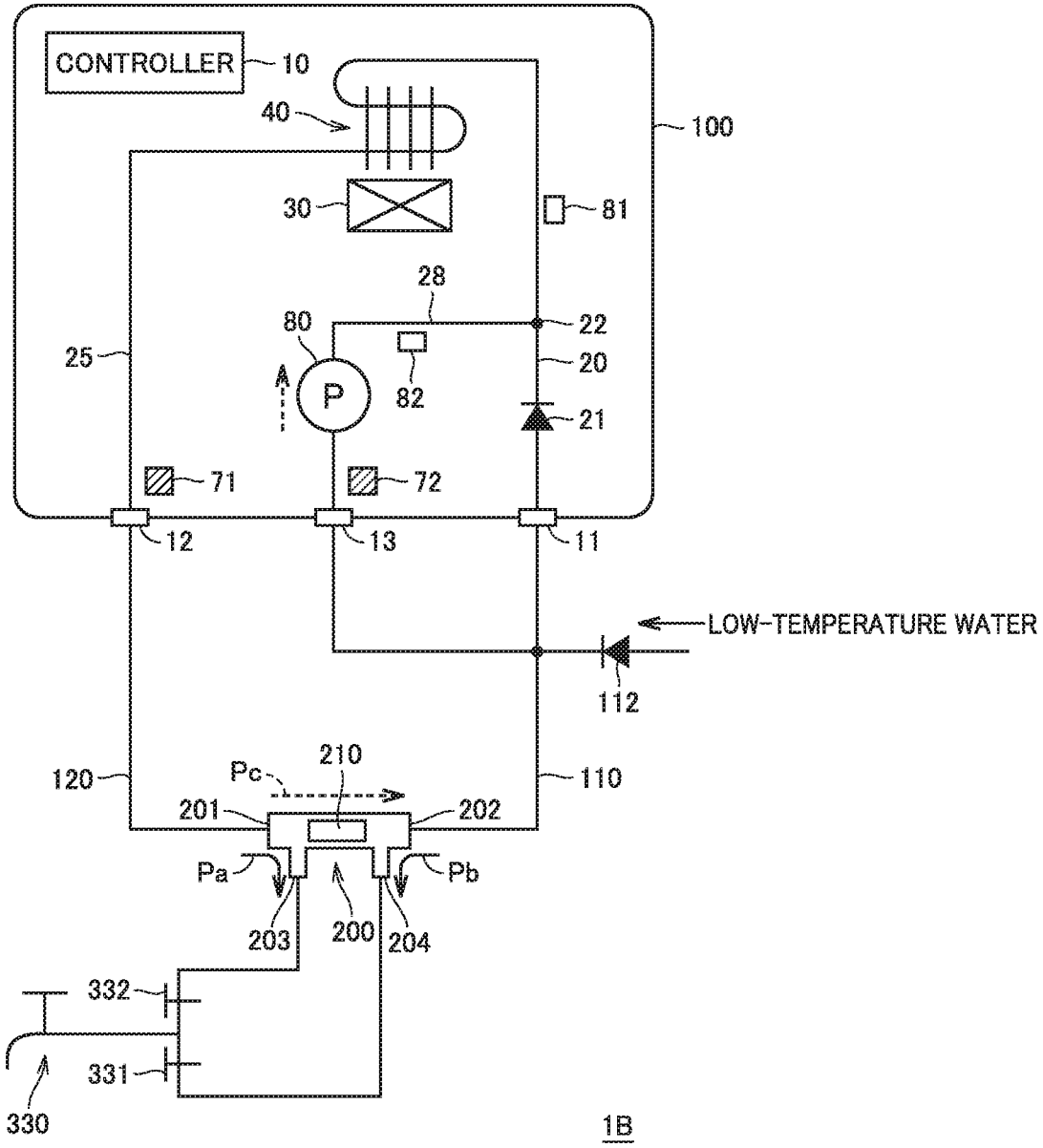
FIG. 3 is a block diagram illustrating a configuration of a water heating system provided with the immediate hot water supply function by connection of a crossover valve.
FIG. 4 shows a chart illustrating switching between flow paths by means of the crossover valve shown in FIG. 2.

FIG. 3 is a block diagram illustrating a configuration of a water heating system provided with the immediate hot water supply function by connection of a crossover valve.

Referring to FIG. 3, a water heating system 1B includes water heating apparatus 100 as in FIG. 1, low-temperature water pipe 110, high-temperature water pipe 120, and a crossover valve 200. Low-temperature water pipe 110 is supplied with low-temperature water through check valve 112 as in FIG. 1. Water entry port 11 and circulation port 13 of water heating apparatus 100 are connected to low-temperature water pipe 110.

Circulation pump 80 can be connected to circulation path 28 as in water heating system 1A in FIG. 1. Alternatively, circulation pump 80 may be connected between low-temperature water pipe 110 and circulation port 13 on the outside of water heating apparatus 100. Controller 10 can also be configured as in water heating system 1A.

Crossover valve 200 is configured similarly to the thermostatically controlled bypass valve described in U.S. Pat. No. 6,536,464 above and includes ports 201 to 204 and a wax thermostatic element 210. Ports 201 and 203 internally communicate with each other and ports 202 and 204 internally communicate with each other. Wax thermostatic element 210 is connected between ports 201 and 203 and ports 202 and 204.

Wax thermostatic element 210 forms a bypass path between ports 201 and 203 and ports 202 and 204 in a low-temperature state. Wax thermostatic element 210 closes the bypass path owing to thermal expansion force in a high-temperature state. A switching temperature at which switching between formation and closing of the bypass path is made is designed in advance depending on a material and a configuration of wax thermostatic element 210. A state that a fluid temperature in crossover valve 200 is higher than the switching temperature is also referred to as a high-temperature state and a state that the fluid temperature is lower than the switching temperature is also referred to as a low-temperature state below.

Crossover valve 200 thus corresponds to an embodiment of the "thermal water stop bypass valve." A pressure loss in the bypass path is designed to be higher than a pressure loss in each of a path through which ports 201 and 203 communicate with each other and a path through which ports 202 and 204 communicate with each other.

Port 201 is connected to high-temperature water pipe 120 and port 202 is connected to low-temperature water pipe 110. Ports 203 and 204 are connected to hot water supply faucet 330. Valves 331 and 332 for manual cut-off can be provided between port 204 and hot water supply faucet 330 and between port 203 and hot water supply faucet 330, respectively. Water heating apparatus 100 performs a normal operation while valves 331 and 332 are open.

FIG. 4 shows a chart illustrating switching between flow paths by means of crossover valve 200 shown in FIG. 3.

Referring to FIGS. 4 and 3, while the faucet is open, that is, while paths from ports 203 and 204 to hot water supply faucet 330 are formed, due to the pressure loss described above, in each of the high-temperature state and the low-temperature state, a flow path Pa between high-temperature water pipe 120 and hot water supply faucet 330 and a flow path Pb between low-temperature water pipe 110 and hot water supply faucet 330 are formed.

While the faucet is closed, that is, while the paths from ports 203 and 204 to hot water supply faucet 330 are cut off, the flow path is switched between the low-temperature state and the high-temperature state. In the low-temperature state, a flow path Pc is formed between ports 201 and 202, that is, between high-temperature water pipe 120 and low-temperature water pipe 110, through a bypass path formed in wax thermostatic element 210. In the high-temperature state, the bypass path is closed so that the flow path between high-temperature water pipe 120 and low-temperature water pipe 110 is cut off.

In the hot water supply operation, as in water heating system 1A in FIG. 1, high-temperature water obtained by heating of low-temperature water introduced into water entry port 11 through low-temperature water pipe 110 by heat source apparatus 30 and heat exchanger 40 (heating mechanism) is output from hot water supply faucet 330 through hot water output port 12 and high-temperature water pipe 120 as well as crossover valve 200 (flow path Pa).

In the immediate hot water supply operation mode, as circulation pump 80 is activated, a fluid path (outer path) from hot water output port 12 through high-temperature water pipe 120, crossover valve 200 (flow path Pc), and low-temperature water pipe 110 to circulation port 13 can be formed on the outside of water heating apparatus 100. In addition, when circulation pump 80 is activated, the inner path as in FIG. 1 can be formed in the inside of water heating apparatus 100. Therefore, the inner path together with the outer path can form the immediate hot water supply circulation path. Consequently, in water heating system 1B as well, by allowing a flow of high-temperature water at an appropriate temperature through the immediate hot water supply circulation path while the faucet is closed, water heating system 1B performs the immediate hot water supply function that allows start of the hot water supply operation with high-temperature water from immediately after the faucet is opened.

Thus, each of water heating system 1B (FIG. 3) in which crossover valve 200 is connected to water heating apparatus 100 and water heating system 1A (FIG. 1) in which crossover valve 200 is not connected to water heating apparatus 100 can execute the immediate hot water supply operation mode by activating circulation pump 80.

Figures 5, 6:
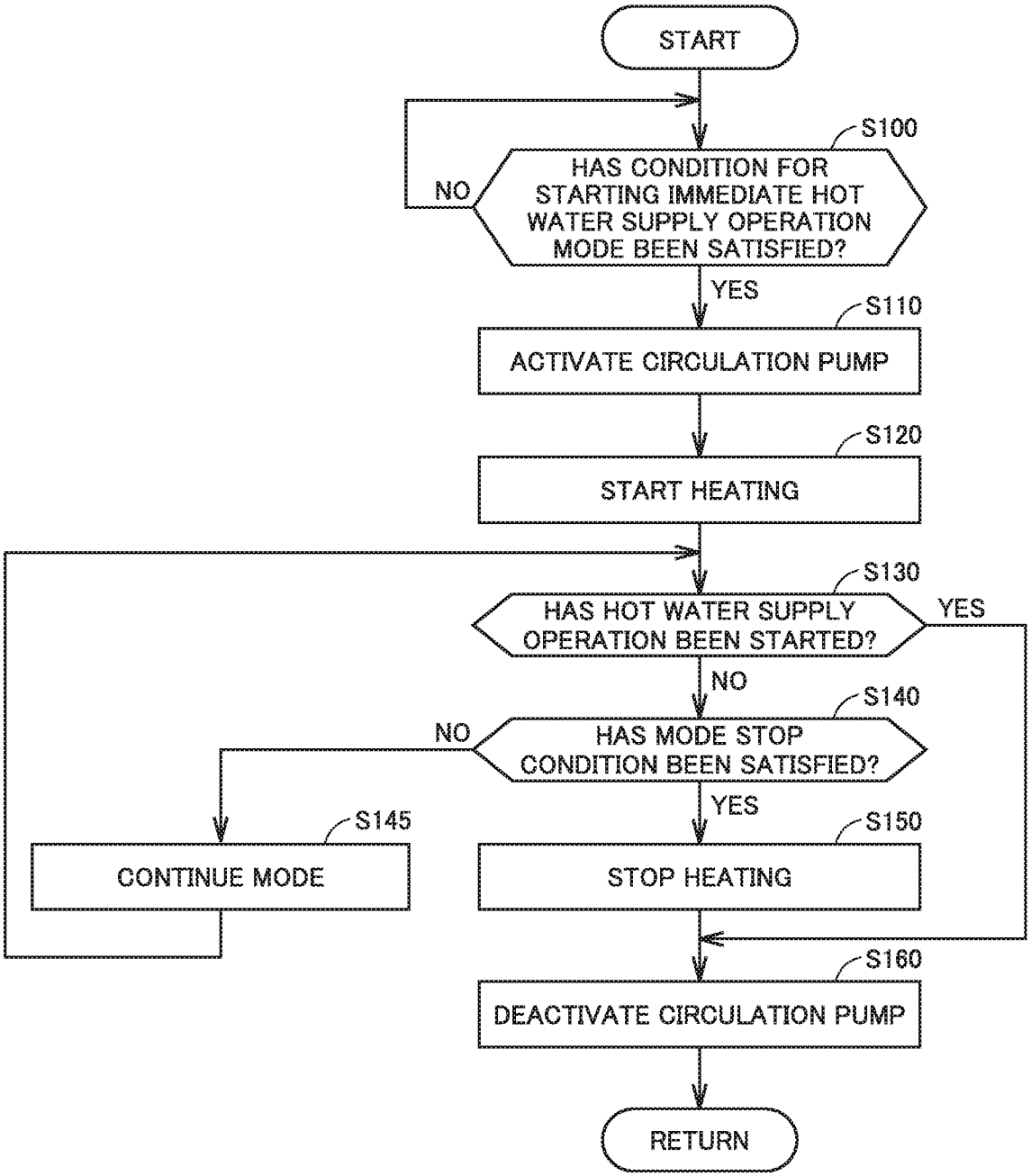
FIG. 5 is a flowchart illustrating a control operation in an immediate hot water supply operation mode in each of the water heating systems shown in FIGS. 1 and 3.
FIG. 6 shows a chart for comparing conditions for stopping the immediate hot water supply operation mode of the water heating systems shown in FIGS. 1 and 3.

FIG. 5 shows a flowchart illustrating a control operation in the immediate hot water supply operation mode in each of water heating systems 1A and 1B.

Referring to FIG. 5, controller 10 determines in a step (which is simply also denoted as "S" below) 100, whether or not a condition for starting the immediate hot water supply operation mode has been satisfied. For example, the start condition is satisfied when a temperature detected by temperature detector 71 is lower than a predetermined temperature while the hot water supply operation is off (while the faucet is closed) within a set period for which the immediate hot water supply operation mode is executed.

When the start condition has been satisfied (determination as YES in S100), controller 10 starts the immediate hot water supply operation mode by starting up processing in S110 or later. When the start condition has not been satisfied (determination as NO in S100), processing in S110 or later is not started up.

Controller 10 generates in S110, a command to activate circulation pump 80. The immediate hot water supply circulation path described above is thus formed in hot water heating systems 1A and 1B. Furthermore, as a command to activate heat source apparatus 30 is generated in S120, heating is started. A temperature of a fluid that passes through the immediate hot water supply circulation path is thus increased.

In the immediate hot water supply operation mode, controller 10 senses in S130, whether or not the hot water supply operation has been started by opening of the faucet (hot water supply faucet 330). For example, in S130, start of the hot water supply operation can be sensed based on change (increase) in detection value from flow rate detector 81. When start of the hot water supply operation has been sensed (determination as YES in S130), controller 10 allows the process to proceed to S160 and generates a command to deactivate circulation pump 80. The immediate hot water supply operation mode is once quitted and the process returns to S100.

While the faucet is closed, that is, when the hot water supply operation has not been started (determination as NO in S130), controller 10 allows the process to proceed to S140 and determines whether or not a condition for stopping the immediate hot water supply operation mode has been satisfied. In water heating systems 1A and 1B, when the temperature of the fluid in the immediate hot water supply circulation path is increased by the time when the faucet is opened, it is preferred in terms of energy efficiency to once deactivate circulation pump 80 and heat source apparatus 30 and to wait for start of the hot water supply operation. The condition for stopping the immediate hot water supply operation mode, however, is different between water heating systems 1A and 1B.

FIG. 6 shows a chart for comparing conditions for stopping the immediate hot water supply operation mode of water heating systems 1A and 1B.

Referring to FIGS. 6 and 1, in water heating system 1A (FIG. 1), in spite of increase in temperature of the fluid, a flow through the immediate hot water supply circulation path via circulation pipe 130 is continued. Therefore, increase in temperature can be sensed based on a temperature detected by temperature detector 71 or 72. Consequently, when a detected temperature Td becomes higher than a predetermined threshold value Tr based on temperature Td detected by temperature detector 71 or 72, an instruction to stop the immediate hot water supply operation mode by deactivating circulation pump 80 and heat source apparatus 30 (heating mechanism) can be given.

In contrast, referring to FIGS. 3 and 6, in water heating system 1B (FIG. 3), when the temperature of the fluid in the immediate hot water supply circulation path increases, the flow path (bypass path) formed by crossover valve 200 is closed and hence the flow rate in the immediate hot water supply circulation path is lowered. Therefore, temperature detector 71 or 72 is unable to sense increase in temperature. Therefore, in water heating system 1B to which crossover valve 200 is connected, based on flow rate detector 81 or 82 rather than a value detected by temperature detector 71 or 72, an instruction to stop the immediate hot water supply operation mode can be given in accordance with lowering in flow rate in the immediate hot water supply circulation path, for example, when a flow rate Qd detected by flow rate detector 81 or 82 is lower than a predetermined threshold value Qr. Alternatively, when flow rate detector 82 is implemented by a water flow switch, an instruction to stop the immediate hot water supply operation mode can be given in response to off of the water flow switch.

Referring again to FIG. 5, controller 10 determines in S140, whether or not a mode stop condition different between water heating systems 1A and 1B shown in FIG. 6 has been satisfied. The immediate hot water supply operation mode is continued, that is, activation of circulation pump 80 and heat source apparatus 30 is continued in S140 until the mode stop condition is satisfied, that is, until the temperature of the fluid in the immediate hot water supply circulation path increases (determination as NO in S140) and processing in S130 to S145 is repeated.

When the mode stop condition has been satisfied with increase in temperature of the fluid in the immediate hot water supply circulation path (determination as YES in S140), controller 10 generates a command to deactivate heat source apparatus 30 and stops heating in S150, and generates a command to deactivate circulation pump 80 in S160. The immediate hot water supply operation mode is thus quitted and the process returns to S100.

Since the condition for stopping the immediate hot water supply operation mode is thus different, for example, controller 10 should have memory 16 (FIG. 2) store in advance information on by which of the immediate hot water supply circulation path (water heating system 1B) formed by connection of crossover valve 200 and the immediate hot water supply circulation path (water heating system 1A) without connection of crossover valve 200 the immediate hot water supply function is performed on the outside of water heating apparatus 100.

Such information can be input to controller 10, for example, in such a manner that a worker provides a special operation input such as an operation of a line or a switch in the inside after the worker opens the front panel at the time of works for attachment of the crossover valve. On the other hand, such works lead to a concern about increase in workloads imposed on an installer and troubles caused by forgotten operation input.

Therefore, in the water heating apparatus according to the present embodiment, a test mode for automatically determining whether or not the crossover valve is connected is introduced.

Figure 7:
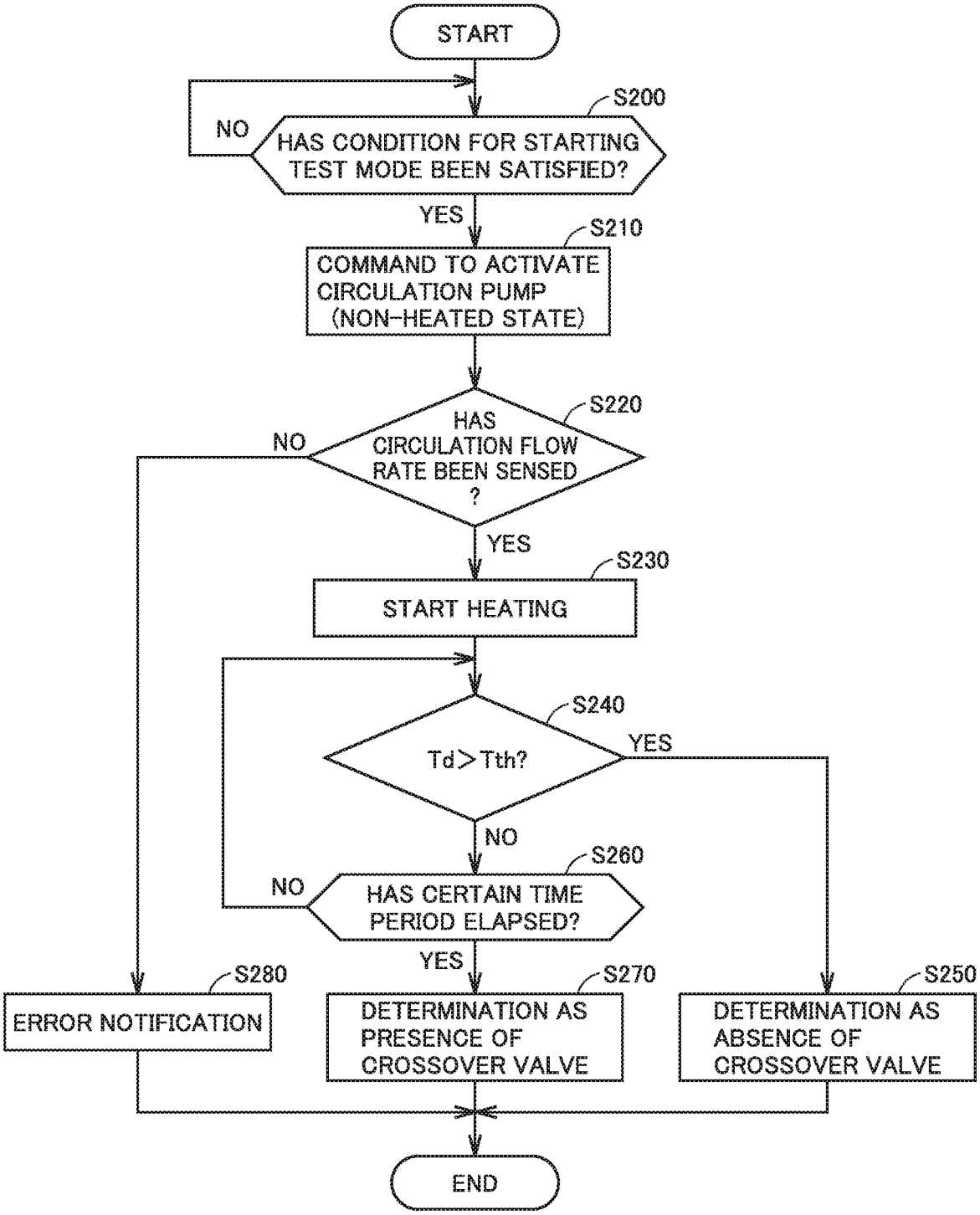
FIG. 7 is a flowchart illustrating a first example of control processing in a test mode performed by a water heating apparatus according to the present embodiment.

FIG. 7 is a flowchart illustrating a first example of control processing in a test mode performed by the water heating apparatus according to the present embodiment. Control processing shown in FIG. 7 is performed by controller 10.

Referring to FIG. 7, controller 10 determines in S200, whether or not a condition for starting the test mode has been satisfied. For example, the start condition is satisfied by providing a predetermined special input to remote controller 92. Alternatively, the start condition may automatically be satisfied as a part of a test run when an instruction to make a test run of water heating apparatus 100 is given. Alternatively, the start condition can also be satisfied at the time of turn-on of power when water heating apparatus 100 is connected to a power supply through an outlet or at the time of first switch-on of the operation switch of water heating apparatus 100. Alternatively, for start of the test mode alone, a start instruction may be given by performing a special operation such as an operation of a line or a switch in the inside after the front panel is opened as described above.

When the condition for starting the test mode has been satisfied (determination as YES in S200), controller 10 starts the test mode by starting up processing in S210 or later. When the start condition has not been satisfied (determination as NO in S200), processing in S210 or later is not started up.

Controller 10 generates in S210, a command to activate circulation pump 80. Thus, the immediate hot water supply circulation path described above is formed in water heating systems 1A and 1B. In addition, controller 10 generates a command to activate heat source apparatus 30 to start heating in S230.

After S210 and before S230, controller 10 can determine in S220, a flow rate in the immediate hot water supply circulation path. Determination in S220 can be made based on a condition for quitting the immediate hot water supply operation mode in water heating system 1B shown in FIG. 6.

For example, when a flow in the immediate hot water supply circulation path has not been sensed (determination as NO in S220) based on a detection value from flow rate detector 81 or 82, controller 10 gives an error notification through notification apparatus 95 and quits the test mode in S280. Thus, start of heating without a water flow through the immediate hot water supply circulation path in the test mode can be prevented. Occurrence of overheating in the test mode can thus be avoided.

When the immediate hot water supply circulation path has normally been formed (determination as YES in S220), controller 10 allows the process to proceed to S230 and establishes a state that heat source apparatus 30 and circulation pump 80 are active.

While heat source apparatus 30 (heating mechanism) and circulation pump 80 are active, controller 10 compares temperature Td detected by temperature detector 71 or 72 (that is, the temperature of the fluid in the immediate hot water supply circulation path) with a predetermined criterion temperature Tth in S240. Criterion temperature Tth is determined in correspondence with the switching temperature of crossover valve 200 described above. Specifically, criterion temperature Tth is set such that determination as NO is made in S240 when the temperature of crossover valve 200 is low and determination as YES is made in S240 when the temperature of crossover valve 200 is high.

In water heating system 1B (FIG. 3), when the temperature of the fluid in the immediate hot water supply circulation path becomes higher than the switching temperature of crossover valve 200, a flow rate through the immediate hot water supply circulation path is lowered and hence temperature detector 71 or 72 does not actually detect Td>Tth. In water heating system 1A (FIG. 1), on the other hand, even when the temperature of the fluid in the immediate hot water supply circulation path increases to a temperature comparable to the switching temperature of crossover valve 200, the flow is continued and hence temperature detector 71 or 72 is able to detect Td>Tth.

Therefore, when increase in temperature (Td>Tth) is sensed while heat source apparatus 30 (heating mechanism) and circulation pump 80 are active (determination as YES in S240), controller 10 determines in S250 that the immediate hot water supply circulation path (water heating system 1A) without connection of crossover valve 200 has been formed and quits the test mode.

Controller 10 determines in S260 whether or not a predetermined certain time period has elapsed since start of heating (S230). When increase in temperature (Td>Tth) has not been sensed in spite of lapse of the certain time period (determination as NO in S240 and determination as YES in S260), the controller determines in S270 that the immediate hot water supply circulation path (water heating system 1B) with connection of crossover valve 200 has been formed and quits the test mode.

Consequently, the water heating apparatus according to the present embodiment can automatically determine in the test mode executed by controller 10, whether or not the crossover valve has externally been connected for forming the immediate hot water supply circulation path.

In addition, when controller 10 quits the test mode, controller 10 has memory 16 store in a non-volatile manner information representing which of determination S250 and determination S270 has been made. Using the stored information, water heating apparatus 100 can appropriately switch the condition for quitting the immediate hot water supply operation mode shown in FIG. 6 in correspondence with whether or not crossover valve 200 is connected. Since a result of determination in the test mode made by controller 10 is thus automatically stored in memory 16 without requiring an operation by a worker, troubles caused by forgotten input by the worker can be avoided.

In the test mode described above, connection of crossover valve 200 is sensed by sensing change in flow rate through the immediate hot water supply circulation path with increase in temperature of the fluid. Therefore, when the test mode is started from a state that the temperature of the fluid is already high (when the temperature is higher than the switching temperature of crossover valve 200), there is a concern about failure in obtaining a correct determination result. Therefore, the condition for starting the test mode for which determination in S200 is made can include a condition that the temperature of the fluid detected by temperature detector 71 or 72 is lower than a predetermined start condition temperature (for example, criterion temperature Tth in S240). Thus, when the temperature of the fluid is higher than the start condition temperature, start of the test mode is prohibited so that execution of the test mode from the state that bypass path Pc in crossover valve 220 has already been closed can be prevented.

Figure 8:
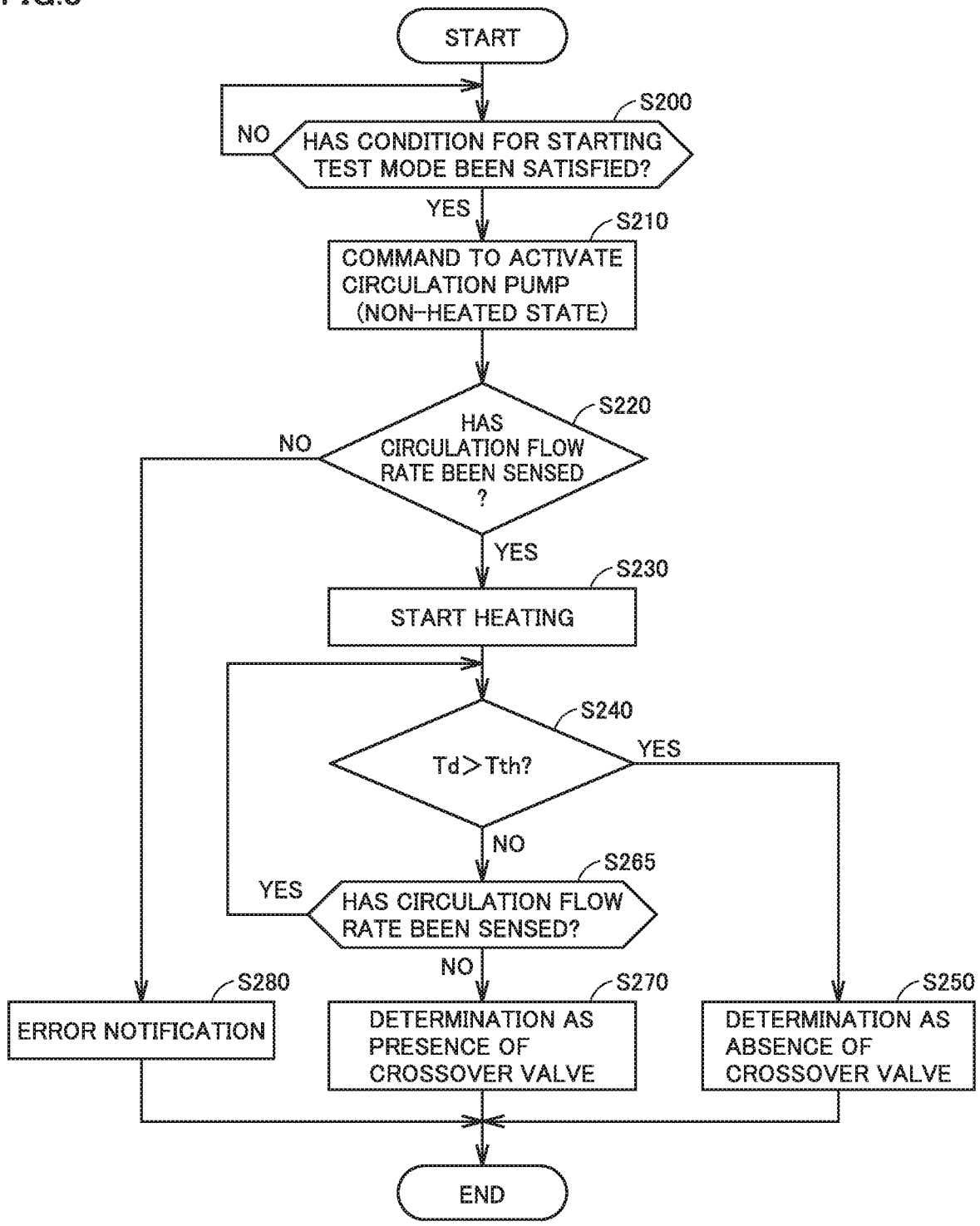
FIG. 8 is a flowchart illustrating a second example of control processing in the test mode performed by the water heating apparatus according to the present embodiment.

FIG. 8 is a flowchart illustrating a second example of control processing in the test mode performed by the water heating apparatus according to the present embodiment. Control processing shown in FIG. 8 is also performed by controller 10.

Referring to FIG. 8, controller 10 performs S265 instead of S260 in the control processing shown in FIG. 7. Controller 10 determines in S265 a flow rate in the immediate hot water supply circulation path as in S220 while heat source apparatus 30 (heating mechanism) and circulation pump 80 are active. Since processing in other steps is the same as in FIG. 7, detailed description will not be repeated.

When a flow in the immediate hot water supply circulation path has not been sensed (determination as NO in S265), controller 10 determines in S270 as in FIG. 7 that the immediate hot water supply circulation path (water heating system 1B) with connection of crossover valve 200 has been formed and quits the test mode.

When the flow in the immediate hot water supply circulation path has been sensed (determination as YES in S265), determination in S240 is continued. Therefore, in water heating system 1A, with increase in temperature of the fluid in the immediate hot water supply circulation path, determination as YES in made in S240 and the process proceeds to S250 as in FIG. 7. Consequently, the controller determines that the immediate hot water supply circulation path (water heating system 1A) without connection of crossover valve 200 has been formed and can quit the test mode.

Thus, also with the use of the control processing in FIG. 8, owing to the test mode executed by controller 10 as in FIG. 7, whether or not the crossover valve has externally been connected for forming the immediate hot water supply circulation path can automatically be determined.

In addition, according to the control processing in FIG. 8, activation of wax thermostatic element 210 in crossover valve 200 can more directly be determined. Therefore, accuracy in determining whether or not the crossover valve has externally been connected can be improved.

Though the immediate hot water supply function performed by water heating apparatus 100 including circulation port 13 is described with reference to FIGS. 1 and 3, arrangement of circulation port 13 is not essential. The immediate hot water supply function can be performed also with the water heating apparatus including only water entry port 11 and hot water output port 12 in both of a case with external connection of the crossover valve and a case without external connection of the crossover valve.

Figure 9:
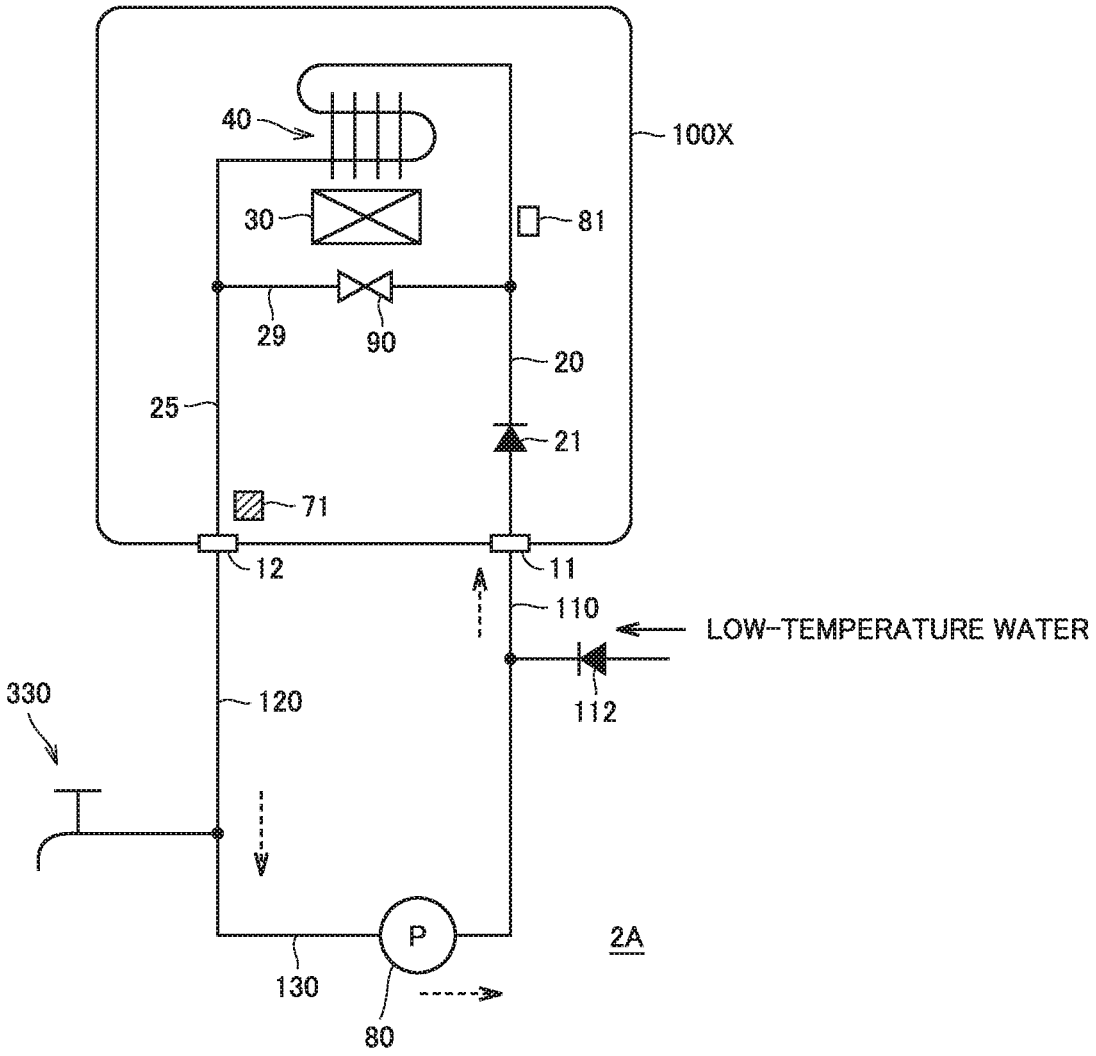
FIG. 9 is a block diagram illustrating a configuration of a water heating system in which a circulation pipe is externally connected to a water heating apparatus according to a modification.

FIG. 9 is a block diagram illustrating a configuration of a water heating system in which a circulation pipe is externally connected to a water heating apparatus according to a modification.

Referring to FIG. 9, a water heating system 2A includes a water heating apparatus 100X according to the modification, low-temperature water pipe 110, high-temperature water pipe 120, and circulation pipe 130. Water heating apparatus 100X includes water entry port 11 and hot water output port 12 without including circulation port 13. Therefore, unlike water heating apparatus 100 in FIG. 1, no circulation path 28 is provided in the inside of water heating apparatus 100X.

In water heating apparatus 100X, a bypass path 29 and a flow rate regulation valve 90 are arranged. In such a bypass configuration, some of low-temperature water is mixed in a portion downstream from heat exchanger 40 as bypassing heat exchanger 40 and remaining unheated, and thus high-temperature water is supplied from hot water output port 12. A temperature of output from heat exchanger 40 (heating mechanism) can thus be high, which is advantageous in suppressing drainage water produced by cooling of exhaust from heat source apparatus 30 at a surface of heat exchanger 40.

The bypass configuration can similarly be applied also to water heating apparatus 100 including circulation port 13. Similarly, water heating apparatus 100X without circulation port 13 can also be configured such that a total amount of low-temperature water passes through heat exchanger 40 without arranging bypass path 29 and flow rate regulation valve 90 as in water heating apparatus 100. The water heating apparatus of interest in the present embodiment can be applied to both of the configuration (FIG. 9) including a bypass path and the configuration (FIG. 1) without a bypass path.

Low-temperature water is supplied to low-temperature water pipe 110 through check valve 112. Low-temperature water pipe 110 is connected to water entry port 11. High-temperature water pipe 120 connects hot water output port 12 and hot water supply faucet 330 to each other. Circulation pipe 130 connects high-temperature water pipe 120 and low-temperature water pipe 110 to each other.

Circulation pump 80 can be connected to circulation pipe 130. During the hot water supply operation in which circulation pump 80 is deactivated, as hot water supply faucet 330 is opened, at least some of low-temperature water introduced from low-temperature water pipe 110 into water entry port 11 is heated by the heating mechanism (heat source apparatus 30 and heat exchanger 40). High-temperature water obtained by heating is output from hot water supply faucet 330 through hot water output port 12 and high-temperature water pipe 120. Water heating apparatus 100X can thus also perform the hot water supply operation similarly to water heating apparatus 100.

When circulation pump 80 is activated while the faucet is closed, a fluid path (inner path) including water entry port 1, water entry path 20, heat exchanger 40 (heating mechanism), hot water output path 25, and hot water output port 12 can be formed in the inside of water heating apparatus 100. In addition, a fluid path (outer path) that extends from hot water output port 12 through high-temperature water pipe 120, circulation pipe 130, and low-temperature water pipe 110 to water entry port 11 and bypasses hot water supply faucet 330 can be formed on the outside of water heating apparatus 100. Consequently, the immediate hot water supply circulation path can be formed also in water heating system 2A.

In water heating system 2A, the immediate hot water supply circulation path is continuously formed in spite of increase in temperature of the fluid as in water heating system 1A. Therefore, as determination as YES is made in S240 in the test mode in accordance with the control processing in FIGS. 7 and 8, it can be determined that the immediate hot water supply circulation path without connection of crossover valve 200 has been formed.

Figure 10:
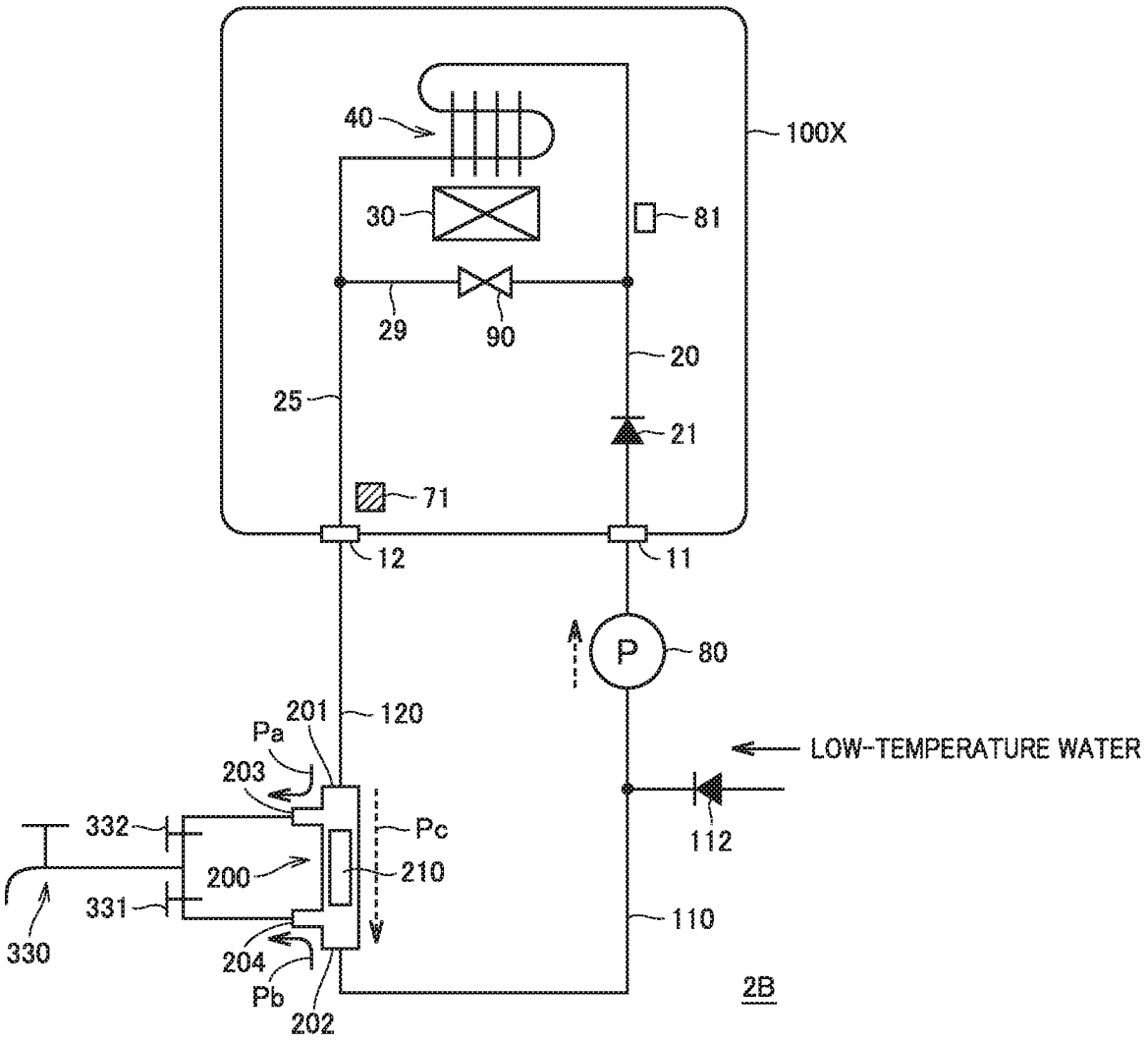
FIG. 10 is a block diagram illustrating a configuration of a water heating system in which a crossover valve is externally connected to the water heating apparatus according to the modification.

FIG. 10 is a block diagram illustrating a configuration of a water heating system in which a crossover valve is externally connected to the water heating apparatus according to the modification.

Referring to FIG. 10, a water heating system 2B includes water heating apparatus 100X as in FIG. 9, low-temperature water pipe 110, high-temperature water pipe 120, and crossover valve 200. Low-temperature water pipe 110 supplied with low-temperature water through check valve 112 has a first end connected to water entry port 11 of water heating apparatus 100X and a second end connected to port 202 of crossover valve 200. Connection of crossover valve 200 to low-temperature water pipe 110, high-temperature water pipe 120, and hot water supply faucet 330 is the same as in water heating system 1B shown in FIG. 2.

In water heating system 2B, during the hot water supply operation, at least some of low-temperature water introduced from low-temperature water pipe 110 into water entry port 11 is heated by the heating mechanism (heat source apparatus 30 and heat exchanger 40). High-temperature water obtained by heating is output from hot water supply faucet 330 through hot water output port 12 and high-temperature water pipe 120 as well as crossover valve 200 (flow path Pa) as in water heating system 1B.

In the immediate hot water supply operation mode, as circulation pump 80 is activated while the faucet is closed, a fluid path (outer path) from hot water output port 12 through high-temperature water pipe 120, crossover valve 200 (flow path Pc), and low-temperature water pipe 110 to water entry port 11 can be formed on the outside of water heating apparatus 100X. In addition, an inner path that passes through water entry port 11, water entry path 20, heat exchanger 40 (heating mechanism), hot water output path 25, and hot water output port 12 can be formed in the inside of water heating apparatus 100X as in FIG. 9. The immediate hot water supply circulation path can be formed by the inner path and the outer path also in water heating system 2B.

The immediate hot water supply circulation path is cut off with increase in temperature of the fluid in water heating system 2B as in water heating system 1B. Therefore, as determination as YES is made in S260 or determination as NO is made in S265 in the test mode in accordance with the control processing in FIGS. 7 and 8, it can be determined that the immediate hot water supply circulation path with connection of crossover valve 200 has been formed.

In water heating systems 2A and 2B, so long as the immediate hot water supply circulation path as above can be formed, circulation pump 80 can be arranged at any position on the outside or in the inside of water heating apparatus 100X without being limited to the configuration in the illustration in FIGS. 9 and 10. Even in such a configuration that circulation pump 80 is not contained in water heating apparatus 100 or 100X, the test mode according to the present embodiment can be realized by including controller 10 that controls deactivation and activation of circulation pump 80.

Crossover valve 200 described in U.S. Pat. No. 6,536,464 above and shown in the present embodiment is merely an exemplary "thermal water stop bypass valve" and a valve containing a bypass path of which formation and closing are switched depending on a temperature could be employed instead of crossover valve 200 in the present embodiment.

Though embodiments of the present invention have been described, it should be understood that the embodiments disclosed herein are illustrative and non-restrictive in every respect. The scope of the present invention is defined by the terms of the claims and is intended to include any modifications within the scope and meaning equivalent to the terms of the claims.

What is claimed is:

1. A water heating apparatus that outputs hot water to a hot water supply faucet, the water heating apparatus comprising:

a heating mechanism;

an inner path that forms, when a circulation pump is activated while the hot water supply faucet is closed, an immediate hot water supply circulation path through which a fluid passes through the heating mechanism, together with an outer path that bypasses the hot water supply faucet on the outside of the water heating apparatus;

a temperature detector that detects a temperature of the fluid in the immediate hot water supply circulation path; and a controller that gives an instruction to activate and deactivate the heating mechanism and the circulation pump, wherein the controller determines, in a test mode, whether the immediate hot water supply circulation path has been formed by connection of a thermal water stop bypass valve, based on whether the temperature detector senses increase in temperature of the fluid to a predetermined criterion temperature while the circulation pump and the heating mechanism are active, wherein the criterion temperature corresponds to a switching temperature at which the thermal water stop bypass valve switches between formation and closing of a bypass path.

2. The water heating apparatus according to claim 1, wherein the controller determines that the immediate hot water supply circulation path has been formed without connection of the thermal water stop bypass valve when the temperature detector senses increase in temperature of the fluid to the criterion temperature while the circulation pump and the heating mechanism are active.

3. The water heating apparatus according to claim 1, wherein the controller determines that the immediate hot water supply circulation path has been formed by connection of the thermal water stop bypass valve when the temperature detector does not sense increase in temperature of the fluid to the criterion temperature in spite of lapse of a predetermined time period while the circulation pump and the heating mechanism are active.

4. The water heating apparatus according to claim 1, further comprising a flow rate detector that senses a flow in the immediate hot water supply circulation path, wherein the controller determines that the immediate hot water supply circulation path has been formed by connection of the thermal water stop bypass valve when the flow rate detector senses lowering in flow rate in the immediate hot water supply circulation path before the temperature detector senses increase in temperature of the fluid to the criterion temperature.

5. The water heating apparatus according to claim 4, wherein in the test mode, the controller establishes a state that the circulation pump and the heating mechanism are active after the flow rate detector has sensed the flow in the immediate hot water supply circulation path while the heating mechanism has been deactivated and the circulation pump is active.

6. The water heating apparatus according to claim 1, further comprising a flow rate detector that senses a flow in the immediate hot water supply circulation path, wherein in the test mode, the controller establishes a state that the circulation pump and the heating mechanism are active after the flow rate detector has sensed the flow in the immediate hot water supply circulation path while the heating mechanism has been deactivated and the circulation pump is active.

7. The water heating apparatus according to claim 1, wherein the controller executes the test mode when an instruction to make a test run of the water heating apparatus is given.

8. The water heating apparatus according to claim 1, wherein the controller prohibits start of the test mode when the temperature of the fluid detected by the temperature detector is higher than the criterion temperature before start of the test mode.

9. The water heating apparatus according to claim 1, wherein the controller includes a storage that stores a result of determination as to whether the thermal water stop bypass valve is connected in the test mode, and the controller switches a condition for deactivating the circulation pump and the heating mechanism in an immediate hot water supply operation mode in which the circulation pump and the heating mechanism are activated while the hot water supply faucet is closed, in accordance with the result of determination stored in the storage.

10. A water heating system comprising:

the water heating apparatus according to claim 1;

a low-temperature water pipe that introduces the low-temperature water to the water entry port of the water heating apparatus;

a high-temperature water pipe that connects the hot water output port of the water heating apparatus and the hot water supply faucet to each other;

the circulation pump arranged inside or outside the water heating apparatus; and the immediate hot water supply circulation path formed to include at least one of the low-temperature water pipe and the high-temperature water pipe and to bypass the hot water supply faucet on outside of the water heating apparatus, and to pass through the heating mechanism in inside of the water heating apparatus, as the circulation pump is activated while the hot water supply faucet is closed.

11. The water heating system according to claim 10, wherein the controller determines that the immediate hot water supply circulation path has been formed without connection of the thermal water stop bypass valve when the temperature detector senses increase in temperature of the fluid to the criterion temperature while the circulation pump and the heating mechanism are active.

12. The water heating system according to claim 10, wherein the controller determines that the immediate hot water supply circulation path has been formed by connection of the thermal water stop bypass valve when the temperature detector does not sense increase in temperature of the fluid to the criterion temperature in spite of lapse of a predetermined time period while the circulation pump and the heating mechanism are active.

13. The water heating system according to claim 10, further comprising a flow rate detector that senses a flow in the immediate hot water supply circulation path, wherein the controller determines that the immediate hot water supply circulation path has been formed by connection of the thermal water stop bypass valve when the flow rate detector senses lowering in flow rate in the immediate hot water supply circulation path before the temperature detector senses increase in temperature of the fluid to the criterion temperature.

14. The water heating system according to claim 9, further comprising a flow rate detector that senses a flow in the immediate hot water supply circulation path, wherein in a case it is determined in the test mode that the thermal water stop bypass valve is not connected, the controller is configured to instruct to deactivate the circulation pump and the heating mechanism on condition that a temperature detected by the temperature detector becomes higher than a predetermined threshold value; and in a case it is determined in the test mode that the thermal water stop bypass valve is connected, the controller is configured to instruct to deactivate the circulation pump and the heating mechanism on condition that a flow rate detected by flow rate detector is lower than a predetermined threshold value.

* * * * *